US008883702B2

(12) United States Patent
Bonsall et al.

(10) Patent No.: US 8,883,702 B2
(45) **Date of Patent: *Nov. 11, 2014**

(54) PACKAGED PARTICULATE DETERGENT COMPOSITION

(75) Inventors: Judith Maria Bonsall, Wirral (GB); Stephen Thomas Keningley, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/878,459

(22) PCT Filed: May 6, 2011

(86) PCT No.: PCT/EP2011/057310

§ 371 (c)(1), (2), (4) Date: Apr. 9, 2013

(87) PCT Pub. No.: WO2012/048910

PCT Pub. Date: Apr. 19, 2012

(65) Prior Publication Data

US 2013/0196892 A1 Aug. 1, 2013

(30) Foreign Application Priority Data

| | | |
|---|---|---|
| Oct. 14, 2010 | (EP) | 10187496 |
| Oct. 14, 2010 | (EP) | 10187497 |
| Oct. 14, 2010 | (EP) | 10187498 |
| Oct. 14, 2010 | (EP) | 10187499 |
| Oct. 14, 2010 | (EP) | 10187506 |
| Oct. 14, 2010 | (EP) | 10187507 |
| Oct. 14, 2010 | (EP) | 10187508 |

(51) Int. Cl.

| | |
|---|---|
| ***C11D 17/04*** | (2006.01) |
| ***C11D 3/10*** | (2006.01) |
| ***D06L 1/00*** | (2006.01) |
| ***C11D 11/00*** | (2006.01) |
| ***B65D 41/26*** | (2006.01) |
| ***C11D 17/00*** | (2006.01) |

(52) U.S. Cl.

CPC ..... *C11D 17/041* (2013.01); *C11D 11/0017* (2013.01); *C11D 3/10* (2013.01); *B65D 41/26* (2013.01); *C11D 17/0039* (2013.01)

USPC ..... 510/293; 510/439; 510/441; 510/442; 510/451; 8/137

(58) Field of Classification Search

CPC .... C11D 17/0039; C11D 17/041; C11D 3/10; C11D 11/0017

USPC ..... 510/293, 439, 441, 442, 451; 8/137

See application file for complete search history.

(56) References Cited

U.S. PATENT DOCUMENTS

| | | | | |
|---|---|---|---|---|
| 2,480,579 | A | 8/1949 | Holuba | |
| 3,887,614 | A * | 6/1975 | Susuki et al. | 510/455 |
| 3,989,635 | A | 11/1976 | Toyoda | |
| 4,269,722 | A | 5/1981 | Joshi et al. | |
| 4,308,625 | A | 1/1982 | Kitto | |
| 4,664,817 | A | 5/1987 | Wixon | |
| 6,114,297 | A * | 9/2000 | Yamaguchi et al. | 510/351 |
| 6,159,920 | A | 12/2000 | Ridyard | |
| 6,284,722 | B1 * | 9/2001 | Yamaguchi et al. | 510/357 |
| 6,596,683 | B1 | 7/2003 | Ebihara | |
| 6,730,652 | B1 | 5/2004 | Painter et al. | |
| 6,747,000 | B2 * | 6/2004 | Pearce et al. | 510/446 |
| 6,846,795 | B2 * | 1/2005 | Lant et al. | 510/446 |
| 6,858,572 | B1 | 2/2005 | Mort, III | |
| 7,022,660 | B1 | 4/2006 | Mort et al. | |
| 2004/0198629 | A1 | 10/2004 | Raehse | |
| 2004/0235704 | A1 | 11/2004 | Wasserman | |
| 2006/0019860 | A1 | 1/2006 | Cardozo | |
| 2006/0160717 | A1 * | 7/2006 | Itakura et al. | 510/447 |
| 2010/0069282 | A1 * | 3/2010 | Prabhat et al. | 510/276 |

FOREIGN PATENT DOCUMENTS

| | | | |
|---|---|---|---|
| DE | 102006034900 | | 1/2008 |
| DE | 102006034900 | A1 | 1/2008 |
| EP | 0057611 | A2 | 8/1982 |
| EP | 0567140 | A1 | 10/1993 |
| EP | 0877079 | A1 | 11/1998 |
| EP | 0962424 | A1 | 12/1999 |
| EP | 1081219 | A2 | 3/2001 |
| EP | 2166077 | A1 | 3/2010 |
| GB | 688752 | | 3/1953 |
| GB | 2076011 | | 11/1981 |

(Continued)

OTHER PUBLICATIONS

PCT International Search Report in PCT application PCT/EP2011/057310 dated Sep. 14, 2011 with Written Opinion.

(Continued)

*Primary Examiner* — Lorna M Douyon

(74) *Attorney, Agent, or Firm* — Greenberg Traurig, LLP

(57) ABSTRACT

A packaged particulate detergent composition, wherein the composition comprises greater than 40 wt % detergent surfactant, at least 70% by number of the particles comprising a core, comprising mainly surfactant, and around the core, a water soluble coating in an amount of from 10 to 45 wt % based on the coated particle, each coated particle having perpendicular dimensions x, y and z, wherein x is from 0.2 to 2 mm, y is from 2.5 to 8 mm, and z is from 2.5 to 8 mm, the packaged particles being substantially the same shape and size as one another.

20 Claims, No Drawings

(56) References Cited

FOREIGN PATENT DOCUMENTS

| | | | |
|---|---|---|---|
| WO | WO9325729 | | 12/1993 |
| WO | WO9932599 | | 7/1999 |
| WO | WO0078912 | A1 | 12/2000 |
| WO | WO2010122050 | A2 | 10/2010 |
| WO | WO2010122051 | A1 | 10/2010 |

OTHER PUBLICATIONS

PCT International Search Report in PCT application PCT/EP2011/063748 dated Nov. 9, 2011 with Written Opinion.
European Search Report in EP application EP 10 18 7494 dated Mar. 4, 2011.
Co-pending Application: Batchelor et al., U.S. Appl. No. 13/878,440, filed Jul. 18, 2013.
PCT International Search Report in PCT application PCT/EP2011/065149 dated Dec. 20, 2011 with Written Opinion.
European Search Report in EP application EP 10 18 7509 dated Mar. 16, 2011.
Co-pending Application: Applicant: Batchelor et al., U.S. Appl. No. 13/878,442, filed Jul. 12, 2013.
PCT International Search Report in PCT application PCT/EP2011/065124 dated Jan. 20, 2012 with Written Opinion.
European Search Report in EP application EP 10 18 7495 dated Mar. 8, 2011.
Co-pending Application: Applicant: Keningley et al., U.S. Appl. No. filed Jul. 9, 2013.
PCT International Search Report in PCT application PCT/EP2011/065150 dated Dec. 16, 2011 with Written Opinion.
European Search Report in EP application EP 10 18 7511 dated Mar. 21, 2011.
Co-pending Application: Applicant: Batchelor et al., U.S. Appl. No. 13/878,447, filed Jul. 12, 2013.
PCT International Search Report in PCT application PCT/EP2011/065152 dated Dec. 15, 2011 with Written Opinion.
European Search Report in EP application EP 10 18 7512 dated Mar. 23, 2011.
Co-pending Application: Applicant: Batchelor et al., U.S. Appl. No. 13/878,448, filed Jul. 8, 2013.
PCT International Search Report in PCT application PCT/EP2011/065153 dated Dec. 5, 2011 with Written Opinion.
European Search Report in EP application EP 10 18 7513 dated Mar. 16, 2011.
Co-pending Application: Applicant: Batchelor et al., U.S. Appl. No. 13/878,450, filed Jul. 12, 2013.
PCT International Search Report in PCT application PCT/EP2011/065154 dated Dec. 16, 2011 with Written Opinion.
European Search Report in EP application EP 10 18 7514 dated Mar. 23, 2011.
Co-pending Application: Applicant: Bonsall et al., U.S. Appl. No. 13/878,451, filed Jul. 12, 2013.
PCT International Search Report in PCT application: PCT/EP2011/057309 dated Jul. 15, 2011 with Written Opinion.
European Search Report in EP application EP 10 18 7506 dated Mar. 16, 2011.
Co-pending Application: Applicant: Bonsally et al., U.S. Appl. No. 13/878,456, filed Jul. 8, 2013.
PCT International Search Report in PCT application PCT/EP2011/067735 dated Jan. 23, 2012 with Written Opinion.
European Search Report in EP application EP 10 18 7520 dated Mar. 7, 2011.
PCT International Search Report in PCT application PCT/EP2011/067159 dated Jan. 25, 2012 with Written Opinion.
European Search Report in EP application EP 10 18 7500 dated Mar. 28, 2011.

* cited by examiner

PACKAGED PARTICULATE DETERGENT COMPOSITION

TECHNICAL FIELD

This invention relates to a packaged particulate concentrated detergent composition intended for use at low dosage levels, for example less than 40 g dose per wash. In particular it relates to particulate detergent compositions formed by extrusion and coating.

BACKGROUND

Particulate detergent compositions with improved environmental profiles could, in theory, be designed by eliminating all components from the composition that provide limited, or no, cleaning action. Such compact products would also reduce packaging requirements. However, to achieve this objective is difficult in practice because the manufacture of particulate detergent compositions usually requires the use of components that do not contribute significantly to detergency, but are nevertheless included to structure liquid ingredients into solids, to assist with processing and to improve the handling and stability of the particulate detergent compositions.

In our pending applications, WO2010/122050 and WO2010/122051 we propose to solve these problems by manufacturing a new particulate detergent composition. In general, the manufacture is done using a process comprising the steps of drying a surfactant blend, extruding it and cutting the extrudates to form hard core particles with a diameter of greater than 2 mm and a thickness greater than 0.2 mm. These large core particles are then preferably coated, especially with an inorganic coating.

Compositions comprising at least 70 wt % of these coated large particles with extruded surfactant cores differ from prior art extruded detergent compositions in that they have little or no solid structuring material to harden or structure the surfactant core. Instead, they use blends of low moisture surfactants to give hardness. The choice of surfactant allows the particles to give good detergency even without any conventional detergent builder, thus eliminating the need for such builders in the particles. Although the extruded particles are hard enough to cut to the required shape without deformation, they are hygroscopic and would stick together if not coated. It is therefore advantageous to coat the core particles by spraying inorganic material, such as sodium carbonate, onto them, in a fluid bed. The combination of the coating and the large particle size (5 mm diameter) substantially eliminates any tendency to deform or cake and allows production of a novel free-flowing composition of larger than usual detergent particles with excellent smooth and uniform appearance. Surprisingly, despite their large volume and high density, the particles are fast dissolving with low residues and form clear wash liquors with excellent primary detergency.

No disclosure of packaging or dosing is made in these applications.

A known problem with compact or concentrated compositions is that consumers tend to use more of the composition than is recommended, probably due to their familiarity with the previous less concentrated variant. Various proposals have been made to solve this but we have now found that the problem of unreliable flow of the particles from their container is a major issue for the acceptance of dosing of highly concentrated particulate detergent compositions.

It is an object of the present invention to provide a packaged particulate concentrated detergent composition wherein the flow of the composition from the package is more reliable.

SUMMARY OF THE INVENTION

We have found that particles that are larger than conventional powdered detergent and resemble "oblate spheroids" or discs with rounded surfaces flow in a controlled manner. Without wishing to be bound by theory we attribute the improved flow properties to the size and curved surfaces that facilitate the improved flow and dosing capability. The curved shape of the particles and size, inherently gives a low surface to volume ratio and results in a low contact area per unit mass of particles. The larger particles have greater momentum than smaller particles when in motion which will facilitate flow.

In one aspect the present invention provides a packaged particulate detergent composition, wherein the composition comprises greater than 40 wt % detergent surfactant, at least 70% by number of the particles comprising a core, comprising mainly surfactant, and around the core, a water soluble coating in an amount of from 10 to 45 wt % based on the coated particle, each coated particle having perpendicular dimensions x, y and z, wherein x is from 0.2 to 2 mm, y is from 2.5 to 8 mm, and z is from 2.5 to 8 mm, the packaged particles being substantially the same shape and size as one another, wherein the ratio of the x to y is from 1:2 and 1:10 and the ratio of x to z is from 1:2 and 1:10, and the surfaces of each coated particle are curved in the x, y and z planes.

Preferably the ratio of the x to y is from 1:3 and 1:7 and the ratio of x to z is from 1:3 and 1:7.

Preferably particles are each coated particle has perpendicular dimensions x, y and z, wherein x is from 0.6 to 1.5 mm, y is from 3 to 6 mm, and z is from 3 to 6 mm.

Preferably the coating comprises at least 10 wt % of a water soluble salt. More preferably the water soluble salt comprises an inorganic salt. Most preferably it comprises sodium carbonate. The coating may further comprise a minor amount of sodium carboxy methyl cellulose (SCMC), sodium silicate, water soluble fluorescer, water soluble or dispersible shading dye, pigment, coloured dye and mixtures thereof.

The amount of coating on each coated particle is preferably 20 to 35% by weight of the particle.

The number percentage of the packaged composition of particles comprising the core and coating is preferably at least 85%.

The coated particles preferably comprise from 0.001 to 3 wt % perfume.

The core of the coated particles preferably comprises less than 5 wt %, even more preferably less than 2.5 wt % inorganic materials.

The particles are desirably oblate spheroids with diameter (y and z) of 3 to 6 mm and thickness (x) of 1 to 2 mm.

At least some, and preferably a major portion by number of the particles may be coloured other than white, as this makes it easier to see them flowing and to determine that the required dose level has been reached. Multicoloured, e.g. some blue and some white, particles have been found to provide even higher visual definition for the optimum control of dose. Colour may be imparted by dye, pigment or mixtures thereof.

The package may be any of the conventionally employed types. It may be transparent. It is preferably resealable. Most preferably, it is provided with an outlet that is significantly lower in area than the widest part of the package. Preferably less than 25% of the maximum cross sectional area parallel to the horizontal. The container may be formed from polyolefins including, but not limited to: polypropylene (PP), polyethylene (PE), polycarbonate (PC), polyamides (PA) and/or polyethylene terephthalate (PETE), polyvinylchloride (PVC); and polystyrene (PS). The container may be formed by extrusion, moulding e.g. blow moulding from a preform or by thermoforming or by injection moulding. The container or package may be provided with a handle and/or a dose measuring device, or scoop. The measuring device may be a cap. Most preferably, it is a screw cap as that provides for more reliable protection against ingress of large amounts of water due to the cap being incorrectly replaced in use. The package may be of any convenient size.

For a concentrated detergent composition, this reliable and slower flow turns out to be very important to avoid overdosing. Studies have shown that consumers tend to overdose concentrated compositions and this is bad for their pocket and bad for the environment. Dosing measures are frequently provided, and ignored. A way to throttle back the pouring out of the particulate composition without causing blocked flow is desired. Blocked flow leads to the eventual dosing of an uncontrolled slug of the particulate concentrated composition with more than 40 wt % detergent surfactant, which easily leads to overdosing. This is particularly the case if the powder is dosed directly from the container, as is the habit of many consumers despite the provision of convenient measuring devices. Even if a measuring device is used, for example a cap that measures the required dose, overfilling can lead to spillage, which is both messy and wasteful.

Surprisingly we have found that coated particulate concentrated detergent compositions with large non-spherical similarly shaped and sized particles provide a slow, steady and predictable flow. The dosing behaviour observed during trials suggests that consumers will find this a very easy particulate format to dose to the target low level of, for example, less than 40 g, maybe even less than 30 g per wash. We have determined that this beneficial flow behaviour is due to the way the particles keep flowing even after tamping down in the package and also to the flow being slower and more predictable; which lengthens the dosing time for a unit mass of product and so reinforces the concentration message at the same time as reducing the likelihood of overdosing.

This flow behaviour enables the large non-spherical particles to be packed in a wider range of packaging than is conventionally employed for powders. Indeed transparent packs with relatively narrow pouring spouts designed for liquid detergents have been tried, with success. The particles can also be scooped easily from a package due to the flow properties not being affected by settling during transportation, or storage conditions. It is desirable that the container is resealable to avoid the flow properties being affected by ingress of large amounts of moisture, which could lead to stickiness. However, the large format of the particles reduces the impact of stickiness as the number of potential bridging points is reduced and the force exerted by each particle when it attempts to move is much greater than a conventional powder due to the mass of each particle being about 25 times greater. Thus even under slightly damp conditions, as may be experienced in a laundry room, the coated particles remain more reliably slow flowing.

DETAILED DESCRIPTION OF THE INVENTION

The particles are formed from a core comprising surfactant and a shell coating. The appearance of the coated particles in a package is very pleasing especially when the core particle is formed by extrusion.

Manufacture of the Particles

A preferred manufacturing process is set forth in PCT/EP2010/055256. It comprises blending surfactants together and then drying them to a low moisture content of less than 1%. Scraped film devices may be used. A preferred form of scraped film device is a wiped film evaporator. One such suitable wiped film evaporator is the "Dryex system" based on a wiped film evaporator available from Ballestra S.p.A. Alternative drying equipment includes tube-type driers, such as a Chemithon Turbo Tube® drier, and soap driers. The hot material exiting the scraped film drier is subsequently cooled and broken up into suitable sized pieces to feed to the extruder. Simultaneous cooling and breaking into flakes may conveniently be carried out using a chill roll. If the flakes from the chill roll are not suitable for direct feed to the extruder then they can be milled in a milling apparatus and/or they can be blended with other liquid or solid ingredients in a blending and milling apparatus, such as a ribbon mill. Such milled or blended material is desirably of particle size 1 mm or less for feeding to the extruder.

It is particularly advantageous to add a milling aid at this point in the process. Particulate material with a mean particle size of 10 nm to 10 μm is preferred for use as a milling aid. Among such materials, there may be mentioned, by way of example: Aerosil®, Alusil®, and Microsil®.

Extruding and Cutting

The dried surfactant blend is extruded. The extruder provides further opportunities to blend in ingredients other than surfactants, or even to add further surfactants. However, it is generally preferred that all of the anionic surfactant, or other surfactant supplied in admixture with water; i.e. as paste or as solution, is added into the drier to ensure that the water content can then be reduced and the material fed to and through the extruder is sufficiently dry. Additional materials that can be blended into the extruder are thus mainly those that are used at very low levels in a detergent composition: such as fluorescer, shading dye, enzymes, perfume, silicone antifoams, polymeric additives and preservatives. The limit on such additional materials blended in the extruder has been found to be about 10 wt %, but it is preferred to keep it to a maximum of 5 wt %. Solid additives are generally preferred. Liquids, such as perfume may be added at levels up to 2.5 wt %, preferably up to 1.5 wt %. Solid particulate structuring (liquid absorbing) materials or builders, such as zeolite, carbonate, silicate are preferably not added to the blend being extruded. These materials are not needed due to the self structuring properties of the very dry LAS-based feed material. If any is used the total amount should be less than 5 wt %, preferably less than 4 wt %, most preferably less than 3 wt %. At such levels no significant structuring occurs and the inorganic particulate material is added for a different purpose, for instance as a flow aid to improve the feed of particles to the extruder.

The output from the extruder is shaped by a die plate. The extruded material has a tendency to swell up in the centre relative to the periphery. We have found that if a cylindrical extrudate is regularly sliced as it exits the extruder the resulting shapes are short cylinders with two convex ends. These particles are herein described as oblate spheroids, or lentils. This shape is pleasing visually.

Coating

The sliced extruded particles are then coated. Coating allows the particles to be coloured easily. Coating makes the particles more suitable for use in detergent compositions that may be exposed to high humidity for long periods.

The extruded particles can be considered as oblate spheroids with a major radius "a" and minor radius "b". Hence, the surface area(S) to volume (V) ratio can be calculated as:

$$\frac{S}{V} = \frac{3}{2b} + \frac{3b}{4 \in a^2} \ln\left(\frac{1+\in}{1-\in}\right)_{mm-1}$$

When $\epsilon$ is the eccentricity of the particle.

Although the skilled person might assume that any known coating may be used, for instance organic, including polymer, it has been found to be particularly advantageous to use an inorganic coating deposited by crystallisation from an aqueous solution as this appears to give positive dissolution benefits and the coating gives a good colour to the detergent particle, even at lower coating levels. An aqueous spray-on of coating solution in a fluidised bed may also generate a further slight rounding of the detergent particles during the fluidisation process.

Suitable inorganic coating solutions include sodium carbonate, possibly in admixture with sodium sulphate, and sodium chloride. Food dyes, shading dyes, fluorescer and other optical modifiers can be added to the coating by dissolving them in the spray-on solution or dispersion. Use of a builder salt such as sodium carbonate is particularly advantageous because it allows the detergent particle to have an even better performance by buffering the system in use at an ideal pH for maximum detergency of the anionic surfactant system. It also increases ionic strength, to improve cleaning in hard water, and it is compatible with other detergent ingredients that may be admixed with the coated extruded detergent particles. If a fluid bed is used to apply the coating solution, the skilled worker will know how to adjust the spray conditions in terms of Stokes number and possibly Akkermans number (FNm) so that the particles are coated and not significantly agglomerated. Suitable teaching to assist in this may be found in EP1187903, EP993505 and Powder technology 65 (1991) 257-272 (Ennis).

It will be appreciated by those skilled in the art that multiple layered coatings, of the same or different coating materials, could be applied, but a single coating layer is preferred, for simplicity of operation, and to maximise the thickness of the coating. The amount of coating should lie in the range 10 to 45 wt % of the particle, preferably 20 to 40 wt % for the best results in terms of anti-caking properties of the detergent particles.

The Extruded Particulate Detergent Composition

The coated particles dissolve easily in water and leave very low or no residues on dissolution, due to the absence of insoluble structurant materials such as zeolite. The coated particles have an exceptional visual appearance, due to the smoothness of the coating coupled with the smoothness of the underlying particles, which is also believed to be a result of the lack of particulate structuring material in the extruded particles.

Compositions with up to 100 wt % of the particles are possible when basic additives are incorporated into the extruded particles, or into their coating. The composition may also comprise, for example, an antifoam granule.

Shape and Size

The coated detergent particle is preferably curved. The coated detergent particle is most preferably lenticular (shaped like a whole dried lentil), an oblate ellipsoid, where z and y are the equatorial diameters and x is the polar diameter; preferably y=z. The size is such that y and z are at least 3 mm, preferably at least 4 mm, most preferably at least 5 mm and x lies in the range 0.2 to 2 mm, preferably 1 to 2 mm.

The coated laundry detergent particle may be shaped as a disc.

One skilled in the art will appreciate that the oblate spheroid is formed by a malleable circular exudate being cut as it exits a conduit. The inner section of the exudate travels a greater speed than the edge of the exudate as it is cut forming the oblate spheroid shape. The coating process also serves to further round the edges of the oblate spheroid. One skilled in the art of detergent manufacture will appreciate that there will be some deviation in the exactness of the oblate spheroids.

Core Composition

The core is primarily surfactant. It may also include detergency additives, such as perfume, shading dye, enzymes, cleaning polymers and soil release polymers.

Surfactant

The coated laundry detergent particle comprises between 40 to 90 wt % of a surfactant, most preferably 50 to 80 wt %. In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside Taschenbuch", H. Stache, 2nd Edn., Carl Hauser Verlag, 1981. Preferably the surfactants used are saturated.

1) Anionic Surfactants

Suitable anionic detergent compounds that may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher C8 to C18 alcohols, produced for example from tallow or coconut oil, sodium and potassium alkyl C9 to C20 benzene sulphonates, particularly sodium linear secondary alkyl C10 to C15 benzene sulphonates; and sodium alkyl glyceryl ether sulphates, especially those ethers of the higher alcohols derived from tallow or coconut oil and synthetic alcohols derived from petroleum. Most preferred anionic surfactants are sodium lauryl ether sulphate (SLES), particularly preferred with 1 to 3 ethoxy groups, sodium C10 to C15 alkyl benzene sulphonates and sodium C12 to C18 alkyl sulphates. Also applicable are surfactants such as those described in EP-A-328 177 (Unilever), which show resistance to salting out, the alkyl polyglycoside surfactants described in EP-A-070 074, and alkyl monoglycosides. The chains of the surfactants may be branched or linear.

Soaps may also be present. The fatty acid soap used preferably contains from about 16 to about 22 carbon atoms, preferably in a straight chain configuration. The anionic contribution from soap may be from 0 to 30 wt % of the total anionic. Use of more than 10 wt % soap is not preferred.

Preferably, at least 50 wt % of the anionic surfactant is selected from: sodium C11 to C15 alkyl benzene sulphonates; and, sodium C12 to C18 alkyl sulphates.

Preferably, the anionic surfactant is present in the coated laundry detergent particle at levels between 15 to 85 wt %, more preferably 50 to 80 wt %.

2) Non-Ionic Surfactants

Suitable non-ionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Preferred nonionic detergent compounds are C6 to C22 alkyl phenol-ethylene oxide condensates, generally 5 to 25 EO, i.e. 5 to 25 units of ethylene oxide per molecule, and the condensation products of aliphatic C8 to C18 primary or secondary linear or branched alcohols with ethylene oxide, generally 5 to 50 EO. Preferably, the non-ionic is 10 to 50 EO, more preferably 20 to 35 EO. Alkyl ethoxylates are particularly preferred.

Preferably the non-ionic surfactant is present in the coated laundry detergent particle at levels between 5 to 75 wt %, more preferably 10 to 40 wt %.

Cationic surfactant may be present as minor ingredients at levels preferably between 0 to 5 wt %.

Preferably all the surfactants are mixed together before being dried. Conventional mixing equipment may be used. The surfactant core of the laundry detergent particle may be formed by roller compaction and subsequently coated preferably with an inorganic salt.

Calcium Tolerant Surfactant System

In another aspect the core is calcium tolerant and this is a preferred aspect because this reduces the need for a builder.

Surfactant blends that do not require builders to be present for effective detergency in hard water are preferred. Such blends are called calcium tolerant surfactant blends if they pass the test set out hereinafter. However, the invention may also be of use for washing with soft water, either naturally occurring or made using a water softener. In this case, calcium tolerance is no longer important and blends other than calcium tolerant ones may be used.

Calcium-tolerance of the surfactant blend is tested as follows:

The surfactant blend in question is prepared at a concentration of 0.7 g surfactant solids per litre of water containing sufficient calcium ions to give a French hardness of 40 (4×10-3 Molar Ca2+). Other hardness ion free electrolytes such as sodium chloride, sodium sulphate, and sodium hydroxide are added to the solution to adjust the ionic strength to 0.05M and the pH to 10. The adsorption of light of wavelength 540 nm through 4 mm of sample is measured 15 minutes after sample preparation. Ten measurements are made and an average value is calculated. Samples that give an absorption value of less than 0.08 are deemed to be calcium tolerant.

Examples of surfactant blends that satisfy the above test for calcium tolerance include those having a major part of LAS surfactant (which is not of itself calcium tolerant) blended with one or more other surfactants (co-surfactants) that are calcium tolerant to give a blend that is sufficiently calcium tolerant to be usable with little or no builder and to pass the given test. Suitable calcium tolerant co-surfactants include SLES 1-7EO, and alkyl ethoxylate non-ionic surfactants, particularly those with melting points less than 40° C.

A LAS/SLES surfactant blend has a superior foam profile to a LAS Nonionic surfactant blend and is therefore preferred for hand washing formulations requiring high levels of foam. SLES may be used at levels of up to 30%. A preferred calcium tolerant coated laundry detergent particle comprises 15 to 100 wt % anionic surfactant of which 20 to 30 wt % is sodium lauryl ether sulphate.

A LAS/NI surfactant blend provides a harder particle and its lower foam profile makes it more suited for automatic washing machine use.

The Coating

The coating may comprise a water soluble inorganic salt. Other water compatible ingredients may be included in the coating. For example fluorescer, SCMC, shading dye, silicate, pigments and dyes.

Water Soluble Inorganic Salts

The water soluble inorganic salts are preferably selected from sodium carbonate, sodium chloride, sodium silicate and sodium sulphate, or mixtures thereof, most preferably 70 to 100 wt % sodium carbonate. The water soluble inorganic salt is present as a coating on the particle. The water soluble inorganic salt is preferably present at a level that reduces the stickiness of the laundry detergent particle to a point where the particles are free flowing.

It will be appreciated by those skilled in the art that multiple layered coatings, of the same or different coating materials, could be applied, but a single coating layer is preferred, for simplicity of operation, and to maximise the thickness of the coating. The amount of coating should lay in the range 15 to 45 wt % of the particle, preferably 20 to 40 wt %, even more preferably 25 to 35 wt % for the best results in terms of anti-caking properties of the detergent particles and control of the flow from the package.

The coating is applied to the surface of the surfactant core, by crystallisation from an aqueous solution of the water soluble inorganic salt. The aqueous solution preferably contains greater than 50 g/L, more preferably 200 g/L of the salt. An aqueous spray-on of the coating solution in a fluidised bed has been found to give good results and may also generate a slight rounding of the detergent particles during the fluidisation process. Drying and/or cooling may be needed to finish the process.

By coating the large detergent particles of the current invention the thickness of coating obtainable by use of a coating level of say 5 wt % is much greater than would be achieved on typically sized detergent granules (0.5-2 mm diameter sphere).

For optimum dissolution properties, this surface area to volume ratio must be greater than 3 $mm^{-1}$. However, the coating thickness is inversely proportional to this coefficient and hence for the coating the ratio "Surface area of coated particle" divided by "Volume of coated particle" should be less than 15 $mm^{-1}$.

The Coated Detergent Particle

The coated detergent particle comprises from 70 to 100 wt %, preferably 85 to 90 wt %, of a detergent composition in a package.

Preferably, the coated detergent particles are substantially the same shape and size by this is meant that at least 90 to 100% of the coated laundry detergent particles in the in the x, y and z dimensions are within a 20%, preferably 10%, variable from the largest to the smallest coated laundry detergent particle in the corresponding dimension.

Water Content

The coated particles preferably comprise from 0 to 15 wt % water, more preferably 0 to 10 wt %, most preferably from 1 to 5 wt % water, at 293K and 50% relative humidity. This facilitates the storage stability of the particle and its mechanical properties.

Other Ingredients

The ingredients described below may be present in the coating or the core.

Dye

Dye may advantageously be added to the coating; it may also or alternatively be added to the core. In that case preferably the dye is dissolved in the surfactant before the core is formed.

Dyes are described in Industrial Dyes edited by K. Hunger 2003 Wiley-VCH ISBN 3-527-30426-6.

Dyes are selected from anionic and non-ionic dyes Anionic dyes are negatively charged in an aqueous medium at pH 7. Examples of anionic dyes are found in the classes of acid and direct dyes in the Color Index (Society of Dyers and Colourists and American Association of Textile Chemists and Colorists). Anionic dyes preferably contain at least one sulphonate or carboxylate groups. Non-ionic dyes are uncharged in an aqueous medium at pH 7, examples are found in the class of disperse dyes in the Color Index.

The dyes may be alkoxylated. Alkoxylated dyes are preferably of the following generic form: Dye-NR1R2. The NR1R2 group is attached to an aromatic ring of the dye. R1 and R2 are independently selected from polyoxyalkylene chains having 2 or more repeating units and preferably having 2 to 20 repeating units. Examples of polyoxyalkylene chains include ethylene oxide, propylene oxide, glycidol oxide, butylene oxide and mixtures thereof.

A preferred polyoxyalkylene chain is [(CH2CR3HO)x (CH2CR4HO)yR5) in which x+y≤5 wherein y≥1 and z=0 to 5, R3 is selected from: H; CH3; CH2O(CH2CH2O)zH and mixtures thereof; R4 is selected from: H; CH2O(CH2CH2O) zH and mixtures thereof; and, R5 is selected from: H; and, CH3

A preferred alkoxylated dye for use in the invention is:

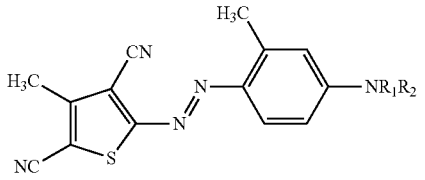

Preferably the dye is selected from acid dyes; disperse dyes and alkoxylated dyes.

Most preferably the dye is a non-ionic dye.

Preferably the dye is selected from those having: anthraquinone; mono-azo; bis-azo; xanthene; phthalocyanine; and, phenazine chromophores. More preferably the dye is selected from those having: anthraquinone and, mono-azo chromophores.

In a preferred process, the dye is added to the coating slurry and agitated before applying to the core of the particle. Application may be by any suitable method, preferably spraying on to the core particle as detailed above.

The dye may be any colour, preferable the dye is blue, violet, green or red. Most preferably the dye is blue or violet.

Preferably the dye is selected from: acid blue 80, acid blue 62, acid violet 43, acid green 25, direct blue 86, acid blue 59, acid blue 98, direct violet 9, direct violet 99, direct violet 35, direct violet 51, acid violet 50, acid yellow 3, acid red 94, acid red 51, acid red 95, acid red 92, acid red 98, acid red 87, acid yellow 73, acid red 50, acid violet 9, acid red 52, food black 1, food black 2, acid red 163, acid black 1, acid orange 24, acid yellow 23, acid yellow 40, acid yellow 11, acid red 180, acid red 155, acid red 1, acid red 33, acid red 41, acid red 19, acid orange 10, acid red 27, acid red 26, acid orange 20, acid orange 6, sulphonated Al and Zn phthalocyanines, solvent violet 13, disperse violet 26, disperse violet 28, solvent green 3, solvent blue 63, disperse blue 56, disperse violet 27, solvent yellow 33, disperse blue 79:1.

The dye is preferably a shading dye for imparting a perception of whiteness to a laundry textile.

The dye may be covalently bound to polymeric species.

A combination of dyes may be used.

Fluorescent Agent

The coated laundry detergent particle preferably comprises a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in the composition is generally from 0.005 to 2 wt %, more preferably 0.01 to 1.0 wt %. Suitable Fluorescers for use in the invention are described in chapter 7 of Industrial Dyes edited by K. Hunger 2003 Wiley-VCH ISBN 3-527-30426-6.

Preferred fluorescers are selected from the classes distyrylbiphenyls, triazinylaminostilbenes, bis(1,2,3-triazol-2-yl) stilbenes, bis(benzo[b]furan-2-yl)biphenyls, 1,3-diphenyl-2-pyrazolines and courmarins. The fluorescer is preferably sulphonated.

Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN. Preferred fluorescers are: sodium 2 (4-styryl-3-sulfophenyl)-2H-napthol[1,2-d]triazole, disodium 4,4'-bis{[(4-anilino-6-(N methyl-N-2 hydroxyethyl) amino 1,3,5-triazin-2-yl)]amino}stilbene-2-2' disulfonate, disodium 4,4'-bis{[(4-anilino-6-morpholino-1, 3,5-triazin-2-yl)]amino}stilbene-2-2' disulfonate, and disodium 4,4'-bis(2-sulfostyryl)biphenyl.

Tinopal® DMS is the disodium salt of disodium 4,4'-bis{ [(4-anilino-6-morpholino-1,3,5-triazin-2-yl)] amino}stilbene-2-2' disulfonate. Tinopal® CBS is the disodium salt of disodium 4,4'-bis(2-sulfostyryl)biphenyl.

Perfume

Preferably, the composition comprises a perfume. The perfume is preferably in the range from 0.001 to 3 wt %, most preferably 0.1 to 1 wt %. Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

It is commonplace for a plurality of perfume components to be present in a formulation. In the compositions of the present invention it is envisaged that there will be four or more, preferably five or more, more preferably six or more or even seven or more different perfume components.

In perfume mixtures preferably 15 to 25 wt % are top notes. Top notes are defined by Poucher (Journal of the Society of Cosmetic Chemists 6(2):80 [1955]). Preferred top-notes are selected from citrus oils, linalool, linalyl acetate, lavender, dihydromyrcenol, rose oxide and cis-3-hexanol.

The perfume may be added into the core either as a liquid or as encapsulated perfume particles. The perfume may be mixed with a nonionic material and applied as a coating the extruded particles, for example by spraying it mixed with molten nonionic surfactant. Perfume may also be introduced into the composition by means of a separate perfume granule and then the detergent particle does not need to comprise any perfume.

It is preferred that the coated detergent particles do not contain a peroxygen bleach, e.g., sodium percarbonate, sodium perborate, peracid.

Polymers

The composition may comprise one or more further polymers. Examples are carboxymethylcellulose, poly (ethylene glycol), poly(vinyl alcohol), polyethylene imines, ethoxylated polyethylene imines, water soluble polyester polymers polycarboxylates such as polyacrylates, maleic/acrylic acid copolymers and lauryl methacrylate/acrylic acid copolymers.

Enzymes

One or more enzymes are preferably present in the composition.

Preferably the level of each enzyme is from 0.0001 wt % to 0.5 wt % protein.

Especially contemplated enzymes include proteases, alpha-amylases, cellulases, lipases, peroxidases/oxidases, pectate lyases, and mannanases, or mixtures thereof.

Suitable lipases include those of bacterial or fungal origin. Chemically modified or protein engineered mutants are included. Examples of useful lipases include lipases from *Humicola* (synonym *Thermomyces*), e.g. from *H. lanuginosa* (*T. lanuginosus*) as described in EP 258 068 and EP 305 216 or from *H. insolens* as described in WO 96/13580, a *Pseudomonas lipase*, e.g. from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus lipase*, e.g. from *B. subtilis* (Dartois et al. (1993), Biochemica et Biophysica Acta, 1131, 253-360), *B. stearothermophilus* (JP 64/744992) or *B. pumilus* (WO 91/16422).

Other examples are lipase variants such as those described in WO 92/05249, WO 94/01541, EP 407 225, EP 260 105, WO 95/35381, WO 96/00292, WO 95/30744, WO 94/25578, WO 95/14783, WO 95/22615, WO 97/04079 and WO 97/07202, WO 00/60063, WO 09/107,091 and WO09/111, 258.

Preferred lipase enzymes include Lipolase™ and Lipolase Ultra™, Lipex™ (Novozymes A/S) and Lipoclean™.

The method of the invention may be carried out in the presence of phospholipase classified as EC 3.1.1.4 and/or EC 3.1.1.32. As used herein, the term phospholipase is an enzyme that has activity towards phospholipids.

Phospholipids, such as lecithin or phosphatidylcholine, consist of glycerol esterified with two fatty acids in an outer (sn-1) and the middle (sn-2) positions and esterified with phosphoric acid in the third position; the phosphoric acid, in turn, may be esterified to an amino-alcohol. Phospholipases are enzymes that participate in the hydrolysis of phospholipids. Several types of phospholipase activity can be distinguished, including phospholipases A1 and A2 which hydrolyze one fatty acyl group (in the sn-1 and sn-2 position, respectively) to form lysophospholipid; and lysophospholipase (or phospholipase B) which can hydrolyze the remaining fatty acyl group in lysophospholipid. Phospholipase C and phospholipase D (phosphodiesterases) release diacyl glycerol or phosphatidic acid respectively.

Suitable proteases include those of animal, vegetable or microbial origin. Microbial origin is preferred. Chemically modified or protein engineered mutants are included. The protease may be a serine protease or a metallo protease, preferably an alkaline microbial protease or a trypsin-like protease. Suitable protease enzymes include Alcalase™, Savinase™, Primase™, Duralase™, Dyrazym™, Esperase™, Everlase™, Polarzyme™, and Kannase™, (Novozymes A/S), Maxatase™, Maxacal™, Maxapem™, Properase™, Purafect™, Purafect OxP™, FN2™, and FN3™ (Genencor International Inc.).

The method of the invention may be carried out in the presence of cutinase. classified in EC 3.1.1.74. The cutinase used according to the invention may be of any origin. Preferably, cutinases are of microbial origin, in particular of bacterial, of fungal or of yeast origin.

Suitable amylases (alpha and/or beta) include those of bacterial or fungal origin. Chemically modified or protein engineered mutants are included. Amylases include, for example, alpha-amylases obtained from *Bacillus*, e.g. a special strain of *B. licheniformis*, described in more detail in GB 1,296,839, or the *Bacillus* sp. strains disclosed in WO 95/026397 or WO 00/060060. Suitable amylases are Duramyl™, Termamyl™, Termamyl Ultra™, Natalase™, Stainzyme™, Fungamyl™ and BAN™ (Novozymes A/S), Rapidase™ and Purastar™ (from Genencor International Inc.).

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g. the fungal cellulases produced from *Humicola insolens, Thielavia terrestris, Myceliophthora thermophila*, and *Fusarium oxysporum* disclosed in U.S. Pat. Nos. 4,435,307, 5,648,263, 5,691,178, 5,776,757, WO 89/09259, WO 96/029397, and WO 98/012307. Cellulases include Celluzyme™, Carezyme™, Endolase™, Renozyme™ (Novozymes A/S), Clazinase™ and Puradax HA™ (Genencor International Inc.), and KAC-500(B)™ (Kao Corporation).

Suitable peroxidases/oxidases include those of plant, bacterial or fungal origin. Chemically modified or protein engineered mutants are included. Examples of useful peroxidases include peroxidases from *Coprinus*, e.g. from *C. cinereus*, and variants thereof as those described in WO 93/24618, WO 95/10602, and WO 98/15257. Peroxidases include Guardzyme™ and Novozym™ 51004 (Novozymes A/S).

Further suitable enzymes are disclosed in WO2009/087524, WO2009/090576, WO2009/148983 and WO2008/007318.

Enzyme Stabilizers

Any enzyme present in the composition may be stabilized using conventional stabilizing agents, e.g., a polyol such as propylene glycol or glycerol, a sugar or sugar alcohol, lactic acid, boric acid, or a boric acid derivative, e.g., an aromatic borate ester, or a phenyl boronic acid derivative such as 4-formylphenyl boronic acid, and the composition may be formulated as described in e.g. WO 92/19709 and WO 92/19708.

Sequestrants may be present in the detergent particles.

The invention will be further described with reference to the following non-limiting examples.

EXAMPLES

In example 1 coated large detergent particles are manufactured, following the process in PCT/EP2010/055256.

Example 1

Preparation of the Coated Particles

Surfactant raw materials were mixed together to give a 67 wt % active paste comprising 85 parts LAS (linear alkyl benzene sulphonate), 15 parts Nonionic Surfactant. The raw materials used were:

LAS: Unger Ufasan 65

Nonionic: BASF Lutensol AO30

The paste was pre-heated to the feed temperature and fed to the top of a wiped film evaporator to reduce the moisture content and produce a solid intimate surfactant blend, which passed the calcium tolerance test. The conditions used to produce this LAS/NI blend are given in Table 1.

TABLE 1

| | | |
|---|---|---|
| | Jacket Vessel Temp. | 81° C. |
| Feed | Nominal Throughput | 55 kg/hr |
| | Temperature | 59° C. |
| | Density | 1.08 kg/l |
| Product | Moisture(KF*) | 0.85% |
| | Free NaOH | 0.06% |

*analysed by Karl Fischer method

On exit from the base of the wiped film evaporator, the dried surfactant blend dropped onto a chill roll, where it was cooled to less than 30° C.

After leaving the chill roll, the cooled dried surfactant blend particles were milled using a hammer mill, 2% Alusil® was also added to the hammer mill as a mill aid.

The resulting milled material is hygroscopic and was stored in sealed containers.

The cooled dried milled composition was fed to a twin-screw co-rotating extruder fitted with a shaped orifice plate and cutter blade. A number of other components were also dosed into the extruder as shown in Table 2.

TABLE 2

| | Example 1 |
|---|---|
| Extruder | Parts (final particle = 100) |
| LAS/NI mixture | 64.3 |
| SCMC | 1.0 |
| Perfume | 0.75 |

The average particle diameter and thickness of samples of the extruded particles were found to be 4.46 mm and 1.13 mm respectively. The standard deviation was acceptably low at less than 10%.

The particles were then coated using a Strea 1 fluid bed. The coating was added as an aqueous solution and coating completed under conditions given in Table 3. Coating wt % is based on weight of the coated particle.

TABLE 3

| Example | 1 |
|---|---|
| Mass Solid [kg] | 1.25 |
| Coating Solution | Sodium Carbonate (30%) |
| Mass Coating Solution [kg] | 1.8 |
| Air Inlet Temperature [° C.] | 80 |
| Air Outlet Temperature [° C.] | 38 |
| Coating Feed Rate [g/min] | 16 |
| Coating Feed temperature [° C.] | 55 |

Coated particles composition is given in Table 4.

TABLE 4

| | Example 1 |
|---|---|
| Extruder | Parts (final particle = 100) |
| LAS/NI mixture | 64.30 |
| SCMC | 1.00 |
| Perfume | 0.75 |
| Fluid bed | |
| Carbonate | 28.25 |
| Minors/Moisture | 5.70 |

The coated extruded particles have an excellent appearance due to their high surface smoothness. Without wishing to be bound by theory it is thought that this is because the uncoated particles are larger and more flattened than usual detergent particles and that their core has a much lower solids content than usual (indeed it is free of solid structuring materials).

Example 2

One skilled in the art will appreciate that the oblate spheroid is formed by a malleable circular exudate being cut as it exits a conduit. The inner section of the exudate travels a greater speed than the edge of the exudate as it is cut forming the "oblate spheroid" shape (discs with rounded surfaces). The coating process also serves to further round the edges of the "oblate spheroid". One skilled in the art of detergent manufacture will appreciate that there will be some deviation in the exactness of the "oblate spheroids".

We measured the ratio of Tapped BD to Poured BD for the coated particles from example 1 (oblate spheroids) and two conventional laundry detergent powders. The results are given in table 5.

Poured BD—The bulk density of the whole detergent composition in the uncompacted (untapped) aerated form, determined by measuring the increase in weight due to pouring the composition to fill a 1 litre container. The container is overfilled and then excess powder removed by moving a straight edge over the brim to leave the contents level to the maximum height of the container.

Tapped BD—The BD container was fitted with a removable collar to extend the height of the container. This extended container was then filled via the poured BD technique. The extended container was then placed on a Retsch Sieve Shaker and allowed to vibrate/tap for 5 min using the 0.2 mm/"g" setting on the instrument. The collar was then removed and the excess powder levelled as per the standard BD measurement, the mass of the container measured and the Tapped BD calculated in the usual way.

TABLE 5

| Particle | Poured BD:tapped BD |
|---|---|
| Coated large size Oblate spheroids * | 1.10 |
| Prior art powder composition 1 "OMO" brand | 1.10 |
| Prior art powder composition 2: "Ariel" brand | 1.15 |

* extruded 5 mm diameter and cut to 1 mm thick before spray coating with sodium carbonate solution to give a particle having a 30 wt % sodium carbonate coating which is an oblate spheroid with slightly flattened equator resulting from the extrusion.

As can be seen from table 1 the larger non-spherical coated particles of the invention settle down in much the same way as the prior art small spherical powders. The small difference in the ratios of Poured BD to tapped BD is not significant.

Example 3

We measured settling volume after tapping for 1 min using the Retsch sieve shaker at a setting of 0.2 mm/"g". The results are given in table 6.

TABLE 6

| Sample | Initial volume | Final volume |
|---|---|---|
| Coated large size Oblate spheroids * | 500 ml | 480 ml |
| Prior art powder composition 1 "OMO" brand | 500 ml | 470 ml |
| Prior art powder composition 2: "Ariel" brand | 500 ml | 445 ml |

Only the large non-spherical coated particles flowed freely out of the measuring cylinder after this experiment. In contrast, both of the prior art powders were compacted and the cylinder needed tapping to get them to flow.

Example 4

Standard DFR (Dynamic Flow Rate) is measured in ml/sec using a cylindrical glass tube having an internal diameter of 35 mm and a length of 600 mm. The tube is securely clamped with its longitudinal axis vertical. Its lower end is terminated by means of a smooth cone of polyvinyl chloride having an internal angle of 15 DEG and a lower outlet orifice of diameter 22.5 mm. A beam sensor is positioned 150 mm above the outlet, and a second beam sensor is positioned 250 mm above the first sensor.

To determine the dynamic flow rate of a detergent composition sample, the outlet orifice is temporarily closed, for example, by covering with a piece of card, and detergent composition is poured into the top of the cylinder until the detergent composition level is about 100 mm above the upper sensor. The outlet is then opened and the time t (seconds) taken for the detergent composition level to fall from the upper sensor to the lower sensor is measured electronically. The DFR is the tube volume between the sensors, divided by the time measured. We mounted this equipment onto the sieve shaker set at 0.2 mm/"g" for 1 min. The shaking or vibration being done after filling the cylinder and before the outlet is opened. Each sample was given one "prod" after vibration to initiate flow as the outlet was narrow and tended to block with all powders. If one prod was insufficient to start flow then zero flow rate was recorded. Results are given in table 7.

TABLE 7

| Sample | Poured DFR ml/s | Tapped DFR ml/s |
|---|---|---|
| Coated large size Oblate spheroids * | 98 | 99 |
| Prior art powder composition 1 "OMO" brand | 114 | 0 |
| Prior art powder composition 2: "Ariel" brand | 51 | 0 |

It can be seen from table 7 that the particles suitable for use in the invention have much improved retention of their flow properties under these conditions—it remained to be determined whether this better retention of flow for these particles was due to their greater size, their non-spherical shape, or their coating (the spherical commercial powders were not coated).

Example 5

TABLE 8

| | Poured DFR ml/s | Tapped DFR ml/s |
|---|---|---|
| Prior art coated granule (small ~500 μm sphere and coated) | 160 | 152 |
| Uncoated large size oblate spheroids | 134 | 124 |

The DFR of the uncoated large non-spherical oblate spheroids was worse than the smaller spherical coated particles under both tests (tapped and untapped). Uncoated oblate spheroids do however, flow much better than the uncoated prior art powders. It is thus feasible to use a small proportion of uncoated oblate spheroid particles in the composition, say up to 30% of the total particles, preferably up to 15% by number.

Surprisingly, from table 8, the coated non-spherical large particles, despite their superior appearance to the uncoated core particles have a lower DFR then the uncoated ones, hence the coating is improving appearance but not the flow. However, the coated particles do have a very consistent DFR. They seem to flow the same way reliably no matter what their history.

The invention claimed is:

1. A packaged particulate detergent composition comprising:

greater than 40 wt % detergent surfactant, wherein at least 70% by number of particles of the packaged particulate detergent composition comprise coated particles;

wherein each coated particle comprises:

(i) a core, wherein the core comprises surfactant, and (ii) around the core, a water soluble coating in an amount of from 10 to 45 wt % based on the coated particle, wherein each coated particle has perpendicular dimensions x, y and z, wherein x is from 0.2 to 2 mm, y is from 2.5 to 8 mm, and z is from 2.5 to 8 mm, wherein the coated particles are substantially the same shape and size as one another, wherein a ratio of the x to the y of each coated particle is from 1:3 and 1:7, wherein a ratio of x to the z of each coated particle is from 1:3 and 1:7, and wherein surfaces of each coated particle are curved in the x, y and z planes.

2. A packaged composition according to claim 1 in which the coating comprises at least 10 wt % of a water soluble salt.

3. A packaged composition according to claim 2 in which the salt comprises an inorganic salt.

4. A packaged composition according to claim 3 in which the inorganic salt comprises sodium carbonate.

5. A packaged composition according to claim 1 in which the amount of coating on each coated particle is from 20 to 35 wt %.

6. A packaged composition according to claim 1 in which the at least 85% by number of the particles of the packaged particulate detergent composition comprise coated particles.

7. A packaged composition according to claim 1 in which the coated particles comprise from 0.001 to 3 wt % perfume.

8. A packaged composition according to claim 1 in which the core of the coated particles comprises less than 5 wt % inorganic material.

9. A packaged composition according to claim 8, wherein the core of the coated particles comprises less than 2.5 wt % inorganic material.

10. A packaged composition according to claim 1 in which the coated particles are oblate spheroids.

11. A packaged composition according to claim 1 in which a major portion by number of the particles in the composition are not white.

12. A packaged composition according to claim 1 in which the package is transparent.

13. A packaged composition according to claim 1 in which the package is resealable.

14. A packaged composition according to claim 12 in which the package is configured to be resealed by a screw cap, wherein the screw cap is configured to serve as a dosing measure.

15. A packaged composition according to claim 1 in which the package comprises an outlet that is lower in area than a maximum cross sectional area parallel to a horizontal of the package.

16. A package composition according to claim 15 in which the area of the outlet is less than 25% of the maximum cross sectional area parallel to the horizontal of the package.

17. A packaged composition according to claim 1, in which the composition is a laundry detergent composition.

18. A packaged composition according to claim 1 in which the x is from 1 to 2 mm and the y and the z are each from 3 to 6 mm.

19. A process for washing of laundry using the packaged composition according to claim 14 comprising the steps of:

removing the screw cap from the package and tipping the package until a required amount of particulate contents of the package have been removed from the package, wherein the required amount is less than 40 g and dosing the required amount to a wash.

20. A process for washing of laundry according to claim 19, wherein the required amount of the particulate contents is less than 25 g.

* * * * *